US006540437B1

(12) United States Patent
Larson

(10) Patent No.: US 6,540,437 B1
(45) Date of Patent: Apr. 1, 2003

(54) END DAM ASSEMBLY FOR DRAINAGE CHANNEL

(75) Inventor: John A. Larson, Parkland, FL (US)

(73) Assignee: Plastic Components, Inc., Miami, FL (US)

( * ) Notice: Subject to any disclaimer, the term of this patent is extended or adjusted under 35 U.S.C. 154(b) by 0 days.

(21) Appl. No.: 09/833,152

(22) Filed: Apr. 12, 2001

(51) Int. Cl.[7] ..... E02B 7/20
(52) U.S. Cl. ..... 405/90; 405/42; 405/87
(58) Field of Search ..... 405/87, 88, 89, 405/90, 107, 114, 118, 119, 120, 121, 42; 52/11, 12, 16, 717.05, 717.03, 716.2; 49/403; 403/403, 382, 282; 292/87; 285/424; 160/327

(56) References Cited

U.S. PATENT DOCUMENTS 1,373,883 A * 4/1921 Gray ..... 405/119
1,460,733 A * 7/1923 Rigby ..... 405/119
4,142,370 A * 3/1979 Giordano ..... 405/119
4,190,988 A * 3/1980 Carreiro ..... 52/16
4,696,131 A * 9/1987 Schreffler ..... 405/119
5,315,090 A * 5/1994 Lowenthal ..... 405/119
5,501,547 A * 3/1996 Mantelli ..... 405/118
5,529,436 A * 6/1996 Meyers ..... 405/119
5,865,498 A * 2/1999 Grogan ..... 52/11
5,971,662 A * 10/1999 Becker et al. ..... 405/119
6,027,283 A * 2/2000 Schweinberg et al. ..... 405/118

* cited by examiner

*Primary Examiner*—Frederick L. Lagman

(57) ABSTRACT

An end dam for a generally U-shaped moisture management channel comprising: a vertical wall having a front and a rear surface and a base edge; a first flange extending at a right angle from the rear surface in the area of the vertical wall base edge, integrally formed therewith, and having a distal edge and a base edge; and a second flange having a base edge extending from and integrally formed with the rear wall, spaced apart from the first flange and extending angularly away from the rear surface toward said first flange distal edge to define a slot between the first and second flanges. The first and second flanges of the end dam frictionally engage the base or bottom of a generally U-shaped moisture management channel causing the vertical wall to abut the sidewalls of such a device.

3 Claims, 1 Drawing Sheet

END DAM ASSEMBLY FOR DRAINAGE CHANNEL

FIELD OF THE INVENTION

The present invention relates to moisture management systems for use over windows, doors and other building openings on buildings where so-called stucco covered, curtain type foamed siding is applied to the exterior of a building. Such moisture management systems inhibit the infiltration of water into the building at the top of such openings by providing a path for the potentially infiltrating water to take away from the surface of the building. This application describes an end dam useful in such moisture management systems for improving the effectiveness of such systems in removing moisture from prior art such systems.

BACKGROUND OF THE INVENTION

The infiltration of water into buildings and other structures particularly at the top of windows, doors etc as well at the base of so-called stucco-covered, curtain type, foamed siding applied to the exterior of buildings is a constant problem in both new and retrofit construction.

The term curtain wall refers to a type of building construction in which an exterior non-load-bearing wall is supported in front of the structural frame like a curtain. Such wall structures, in some instances can be exposed to rain driven by winds, as high as 90 miles per hour in certain areas, and consequently are vulnerable to infiltration of wind driven rain as well as insufficient drainage of accumulated water from the area between the exterior curtain wall and the interior supporting shell of the wall construction.

Particularly vulnerable to infiltration of rainwater in this fashion are the areas over doors and windows and the lower extremity of the curtain wall where it meets the sill or foundation of the building.

The problem of infiltrated water can become critical where the wall area includes large window and or door openings and is often aggravated where water entering the wall cavity accumulates sufficiently to cause leakage into the interior of the building with resulting water damage. In some cases, water entering the wall cavity between the interior load bearing wall and the exterior curtain wall at window and door openings does not drain to the exterior of the building, but soaks through the wall portions causing structural damage and discoloration of the visible exterior portions of the wall.

Consequently, numerous designs have been proposed for moisture management systems and drip edges that either inhibit such infiltration and/or provide a means for conducting infiltrating water away from the opening in a safe and non-destructive manner.

U.S. Pat. No. 3,568,391 to Conway issued Mar. 9, 1971 describes a casing bead for stucco-covered curtain wall construction employing a joint including an elongate L-shaped casing bead and an elongate generally wing-shaped drainage cap member. The two joint components form a horizontally-disposed, structurally yielding joint between outer covering curtain wall sections that provides ventilation and water drainage between adjacent curtain wall panel sections.

U.S. Pat. No. 5,003,743 to Bifano et al, issued Apr. 2, 1991 describes another proposed track device for the installation of curtain wall type siding on structures that includes a flange arrangement designed to inhibit the infiltration of water, but no means to inhibit the conduct of infiltrated water away from the ends of the mounting device.

Vinyl Corporation of Miami, Fla. currently supplies a moisture management system for installation over doors and windows. This moisture management system comprises a generally U-shaped channel having a base including weep holes, front and rear upstanding walls, and a drip plate below the weep holes. The drip plate comprises a separate member welded parallel to the bottom of the base and having a cutout or recess below the weep holes in the base for removal of water passing through the weep holes. Various other somewhat similar but highly improved integrally formed designs of such devices also have been described and marketed to address the foregoing moisture management problems including some that include weep holes along the forward edge of the U-shaped channel to permit the removal of water therefrom.

In all of these cases, due to the necessity of providing a "flexible" system, i.e. one that can be easily fitted to window and door openings of differing width, the terminal or horizontal ends of the moisture gathering generally U-shaped channel tracks or bottoms of such devices have been left open thereby providing an unimpeded path for moisture when present in sufficient quantities to infiltrate the exterior of the building at these points.

OBJECT OF THE INVENTION

It is therefore an object of the present invention to provide an improved moisture management system for installation over doors and windows on buildings utilizing a stucco-covered, curtain wall construction while maintaining the flexibility of width by providing a frictionally engageable end dam that is readily attached to the terminal ends of a moisture management system channel to inhibit the travel of moisture from the channel at these points.

SUMMARY OF THE INVENTION

According to the present invention, there is provided an integrally formed end dam for a generally U-shaped moisture management channel comprising: a vertical wall having a front and a rear surface and a base edge; a first flange extending at a right angle from the rear surface in the area of the vertical wall base edge and integrally formed therewith, and having a distal edge and a base edge; and a second flange having a base edge extending from and integrally formed with said rear wall, spaced apart from the first flange and extending angularly away from said rear surface toward said first flange distal edge. As described more fully below, the first and second flanges of the end dam of the present invention frictionally engage the base or bottom of a generally U-shaped moisture management channel causing the vertical wall to abut the side-walls of such a device to provide a means to arrest the flow of water out of the ends of the U-shaped channel.

DETAILED DESCRIPTION

Figure 1:
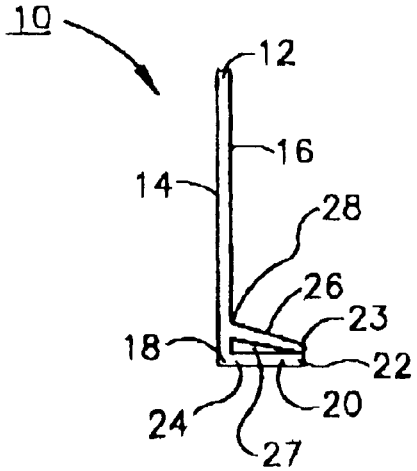
FIG. 1 is a side view of the end dam of the present invention.

Referring now to FIG. 1, end dam 10 of the present invention comprises: a vertical wall 12 having a front surface 14 and a rear surface 16 and a base edge 18; a first flange 20 extending at a right angle from rear surface 16 in the area of the vertical wall base edge 18 and integrally formed therewith, and having a distal edge 22 and a base edge 24; and a second integrally formed flange 26 having a base edge 28 abutting rear wall surface 16, spaced apart from first flange 20 and extending angularly away from rear surface 16 toward said first flange distal edge 22. As can be seen in FIG. 1, first flange 20 and second flange 26 define a slot 27 that is wider at surface 16 and converges at distal end 22 of first flange 20. Distal end 23 of second flange 26 may actually contact distal end 22 or be slightly removed therefrom so long as it is possible to insert the base portion of a generally U-shaped moisture management channel as described hereinafter.

Figure 4:
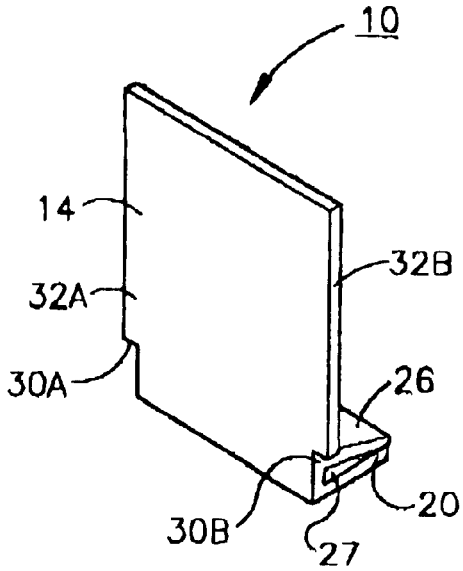
FIG. 4 is a perspective front view of a preferred embodiment of the end dam of the present invention.

FIG. 4 depicts one preferred embodiment of the end dam of the present invention. In the embodiment depicted in FIG. 4, vertical wall 14 includes notches 30*a* and 30*b* cut therein, as well as removal of those portions of first and second flanges 20 and 26 that lie immediately therebehind, to provide vertical wall 14 with wings or extensions 32*a* and 32*b*. The purpose of wings 32*a* and 32*b* are more readily understood by reference to FIG. 2.

Figure 2:
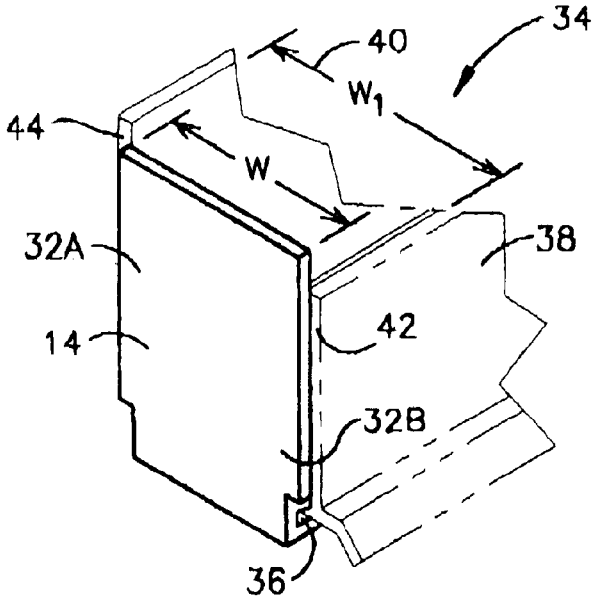
FIG. 2 is a partially phantom perspective view showing a preferred embodiment of the end dam of the present invention installed at the terminal end of a moisture management channel.
Figure 3:
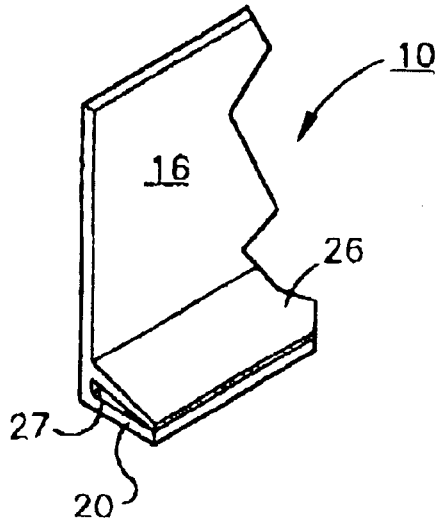
FIG. 3 is a rear side view of one embodiment of the end dam of the present invention.

FIG. 2 depicts end dam 10 of FIG. 4 assembled to a suitable, elongated, generally U-shaped moisture management channel 34 shown in phantom in FIG. 2 and comprising: a base 36, an upstanding front wall 38 and an upstanding rear wall 40 extending in parallel relationship to define the generally U-shaped channel 34. When slot 27 as depicted in FIGS. 1, 3 and 4 is frictionally engaged over base 34 as shown in FIG. 2, wings or extensions 32*a* and 32*b* abut and overlap the ends 42 and 44 of upstanding front wall 38 and upstanding rear wall 40 of channel 34 respectively. In this fashion, a tighter joint is formed between end dam 10 and channel 34 and it is more likely that water that has entered channel 34 will be diverted toward appropriate weep hole in channel 34 (not shown) than if the width of vertical wall W were the same as the internal width W' of channel 34. Thus, the presence of notches 30*a* and 30*b* is clearly preferred.

FIG. 3 depicts end dam 10 in a partially cutaway configuration to indicate the end dam "stock" can be provided in long lengths that can be cut easily to length on site as required by a particular installation.

End dam 10 can be fabricated from any suitable material that demonstrates the appropriate degree of flexibility and resilience to permit slot 27 to open up through deflection of either or both of first and second flanges 20 and 26 such that slot 27 can grip and frictionally engage base 36 of channel 34. It is also highly desirable, since end dam 10 can be fabricated in long lengths, that the material of fabrication be one that is "cutable" on site so that sections can be prepared, i.e. sized to fit differing widths of channel 34. Thus, end dam 10 can be fabricated from a variety of polymeric materials such as polyvinyl chloride and the like, and even metals such as extruded aluminum in an appropriate 6000 series alloy.

While it is not a common form of installation, there may exist a situation where slot 27 should be located at some point further removed from base edge 18, for example, extending at a point intermediate the height of rear wall 16, and such a configuration is also contemplated in the instant invention.

As will be apparent to the skilled artisan, a modification of the end dam assembly described herein for a U-shaped channel could be easily be configured for an L-shaped or otherwise configured channel that would benefit from the incorporation of a suitable, easily installed end dam for the purpose of inhibiting the flow of entrapped water out the ends of the channel.

As will be apparent to the skilled artisan, a number of variations and modifications can be made to the structure described above without departing from the spirit and scope of the invention. All such modifications and changes are clearly contemplated as being within the scope of the appended claims.

What is claimed is:

1. An end dam for a generally U-shaped moisture management channel having a base, an upstanding front wall, an upstanding rear wall extending from said base comprising:

A) a vertical wall having a front and a rear surface and a base edge;

B) a first flange extending at approximately a right angle from the rear surface in the area of the vertical wall base edge and integrally formed therewith, and having a distal edge and a base edge; and C) a second flange having a base edge extending from and integrally formed with said rear wall, spaced apart from the first flange and extending angularly away from said rear surface toward said first flange distal edge thereby defining a slot between said first flange and said second flange for engagement with at least one of said opposing base ends, and wherein said vertical wall has opposing vertical edges and a portion of said opposing vertical edges and said first and second flanges is cutaway to provide wings or extensions of said vertical wall that extend beyond said first and second flanges.

2. In combination:

I) a generally U-shaped moisture management channel comprising:

A) an elongated base having opposing longitudinal edges; and

B) an upstanding front wall and an upstanding rear wall extending along said opposing longitudinal edges; and II) an end dam comprising:

A) a vertical wall having a front and a rear surface and a base edge;

B) a first flange extending at approximately a right angle from the rear surface in the area of the vertical wall base edge and integrally formed therewith, and having a distal edge and a base edge; and C) a second flange having a base edge extending from and integrally formed with said rear wall, spaced apart from the first flange and extending angularly away from said rear surface toward said first flange distal edge thereby defining a slot between said first flange and said second flange, wherein said slot frictionally engages said base, said vertical wall has opposing vertical edges, said upstanding front and rear walls have ends, said opposing vertical edges abut the ends of said upstanding front and rear walls and a portion of said opposing vertical edges and said first and second flanges is cutaway to provide wings or extensions of said vertical wall that extend beyond said first and second flanges.

3. An end dam for a moisture management channel having a base, at least one upstanding wall extending from said base and opposing ends comprising:

A) a vertical wall having a front and a rear surface and a base edge;

B) a first flange extending at approximately a right angle from the rear surface in the area of the vertical wall base edge and integrally formed therewith, and having a distal edge and a base edge; and C) a second flange having a base edge extending from and integrally formed with said rear wall, spaced apart from the first flange and extending angularly away from said rear surface toward said first flange distal edge thereby defining a slot between said first flange and said second flange for engagement with at least one of said base ends, wherein said vertical wall has opposing vertical edges and a portion of said opposing vertical edges and said first and second flanges is cutaway to provide wings or extensions of said vertical wall that extend beyond said first and second flanges.

* * * * *